US005799868A

United States Patent [19]

Neumann

[11] Patent Number: 5,799,868

[45] Date of Patent: Sep. 1, 1998

[54] MULTI-TRACK ROAD CROSSING

[75] Inventor: Bernhard Neumann, Gmunden, Austria

[73] Assignee: Gmundner Fertigteile Gesellschaft m.b.H. & Co. KG, Gmunden, Austria

[21] Appl. No.: 836,211

[22] PCT Filed: Nov. 13, 1995

[86] PCT No.: PCT/AT95/00215

§ 371 Date: May 6, 1997

§ 102(e) Date: May 6, 1997

[87] PCT Pub. No.: WO96/15322

PCT Pub. Date: May 23, 1996

[30] Foreign Application Priority Data

Nov. 15, 1994 [AT] Austria ..... 2108/94

[51] Int. Cl.[6] ..... E01C 9/04

[52] U.S. Cl. ..... 238/8

[58] Field of Search ..... 238/6, 7, 8

[56] References Cited

U.S. PATENT DOCUMENTS

| | | | |
|---|---|---|---|
| 2,089,025 | 8/1937 | Hedgcock | 238/8 |
| 2,137,566 | 11/1938 | Clare | 238/8 |
| 2,833,480 | 5/1958 | Sandberg | 238/8 |
| 4,368,845 | 1/1983 | Perry et al. | 238/8 |
| 4,372,488 | 2/1983 | Schonthaler et al. | 238/8 |
| 5,181,657 | 1/1993 | Davis | 238/8 |
| 5,535,948 | 7/1996 | Williams | 238/8 |
| 5,626,289 | 5/1997 | Demers, Jr. et al. | 238/8 |

FOREIGN PATENT DOCUMENTS

| | | |
|---|---|---|
| 28 43 7 48 | 4/1979 | Germany . |
| 30 27 090 A1 | 7/1980 | Germany . |
| 2 049 768 | 5/1980 | United Kingdom . |
| 87/04477 | 7/1987 | WIPO . |
| 92/02680 | 2/1992 | WIPO . |

*Primary Examiner*—S. Joseph Morano

*Attorney, Agent, or Firm*—Sughrue, Mion, Zinn, Macpeak & Seas, PLLC

[57] ABSTRACT

A multi-track road crossing including a roadway positioned at the level of the rails, which roadway is formed by self-supporting slabs, wherein inner slabs (4) are provided which bridge the space between the rails (2, 3) of each track (G1, G2) and are supported on these rails (2, 3), and wherein outer slabs (6) are provided which are supported on the outer side of a rail (2, 3) of the track (G1, G2) by one of their sides (6*a*) and on a supporting body (10) arranged beside the track by the other one of their sides (6*b*). In the intermediate region (Z) between two tracks, the roadway is formed by self-supporting compensating slabs (11, 11*a*) which on both of their longitudinal rims (12) are supported on the supporting bodies (10, 10*a*) which also support the outer slabs (6) of the respective tracks (G1, G2). The compensating slabs (11, 11*a*) preferably are polymer concrete slabs, in particular made of polyester concrete.

12 Claims, 2 Drawing Sheets

MULTI-TRACK ROAD CROSSING

BACKGROUND OF THE INVENTION

The invention relates to a multi-track road crossing including a roadway located at the level of the rails, which roadway is formed at each track by self-supporting slabs elastically supported on the rail bases on at least one side, i.e. inner slabs bridging the space between the two rails of the respective track and supported on these two rails, and outer slabs each covering a strip-shaped region externally of the rails of the respective track and elastically supported on the externally pointing rail bases at their side facing these rails, and supported on supporting bodies laid beside the respective track on their side facing away from these rails, the roadway in the middle of the intermediate region between neighbouring tracks being formed by a filling.

In known multi-track road crossings of the initially mentioned type the roadway in the intermediate region between neighbouring tracks is formed by a filling in the form of an asphalt bituminous mixture roadway covering. Thus, the individual track portions are to be considered as separated by this intermediate region. This asphalt strip has a roadway grip behaviour different from that prevailing in the track region, where e.g. concrete slabs are laid, thus adding additional danger to the risks of a road portion which already bears various risks for road traffic. Moreover, the asphalt layer tends to become crushed and fluted by the pressure of the wheels of heavy vehicles and to become faulty due to brittleness, and the asphalt covering rests on its own bed of crushed stone on the soil and does not follow level changes of the track. Moreover, during maintenance work carried out on the tracks, as a rule the asphalt covering must be torn up and then remade (e.g. because of a new or changed level, respectively), with negative consequences for road traffic because such asphalt work in this intermediate region mostly requires a partial or complete closing of this section of the road, and a further disadvantage resides in the fact that in most cases only small construction equipment can be used for the asphalt work, or the repair work can be carried out by hand only.

SUMMARY OF THE INVENTION

The invention has as its object to provide a multi-track road crossing in which the disadvantages of known level crossings as previously mentioned are avoided. The road crossing according to the invention is characterized in that the filling is formed by self-supporting compensating slabs which, at both of their longitudinal rims, are supported on the supporting bodies that also support the outer slabs.

The advantages of this design with compensating slabs consist in that equal roadway characteristics, in particular an equal grip behaviour of the roadway surface in the entire transition area, are provided and problems of level cannot occur because the compensating slabs are supported on the same supporting bodies as the outer slabs. Even after extended periods of time there will be no changes in the levels of the slab surfaces relative to each other. For the purpose of maintenance work, the compensating slabs can be lifted off easily and without requiring much time, and their production and storage will be economically suitable since compensating slabs can be comparatively narrow. A major part of the distance between the tracks is covered by the outer slabs which can be made of uniform dimensions because of the use of compensating slabs. The compensating slabs may be lifted off at any time without any problems, and the space below the compensating slabs can be utilized to guide cables or the like therein.

Furthermore, the supporting bodies supporting the compensating slabs can be superposed or positioned easily on the pedestals prepared for the latter of site-mixed concrete or concrete blocks, resulting in a good seating of the said compensating slabs. To prevent possible shifts of the supporting bodies as could possibly occur on account of high traffic loads it is, e.g., possible to interconnect oppositely arranged supporting bodies by means of spacers whereupon a good long-term stability of the positioning of these supporting bodies relative to each other can be expected. The supporting bodies provided in the road crossing according to the invention advantageously comprise on their upper side a longitudinally extending rib which ends horizontally at the level of the rails or of the road covering, respectively, and which separates the supporting surfaces for the compensating slabs from the supporting surfaces for the outer slabs, whereby secure positioning of both of these types of slabs can be achieved. In a preferred embodiment of the supporting bodies, the longitudinally extending rib is configured such that the lateral surface of the rib facing the supporting surface for the compensating slabs extends obliquely in vertical direction and approaches the other rib side in the upward direction and that the edge surfaces of the compensating slabs extending along this rib extend also obliquely so as to correspond to the obliquely extending lateral surfaces of the longitudinally extending ribs of the supporting bodies, which facilitates both handling of the compensating slabs during installation thereof as well as adjustments of their positions.

The compensating slabs according to the invention may advantageously be formed of polymer concrete. They thus exhibit a high strength and do not require any metal frame (different from cement concrete slabs, e.g.), and thus can be produced without any problems in different dimensions, they have a good surface grip behaviour and do not give rise to insulating problems, as may occur when using metal frame-reinforced cement concrete slabs.

The invention will now be explained in more detail with reference to examples schematically illustrated in the drawings.

DETAILED DESCRIPTION OF THE INVENTION

Figure 1:
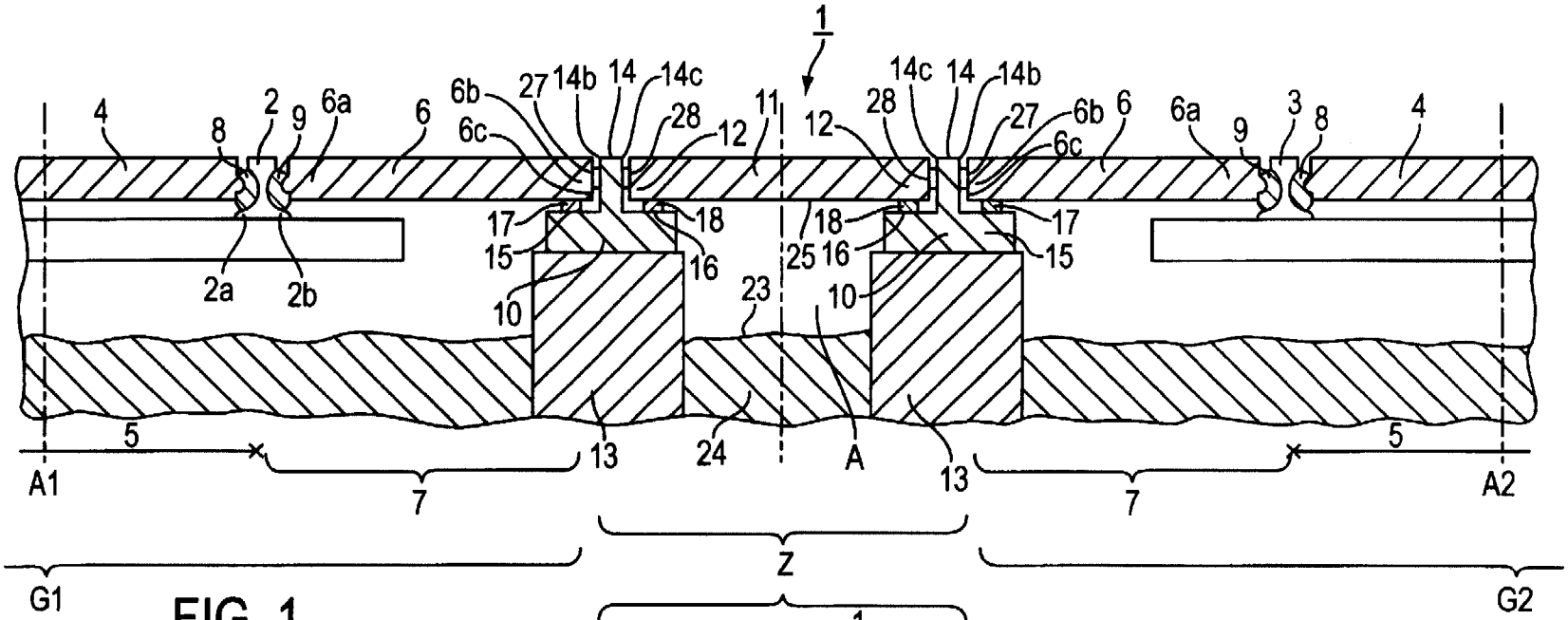
FIG. 1 shows a first embodiment of a multi-rail road crossing designed according to the invention in a cross-section according to line I–I of FIG. 2, the portion located between the individual tracks being illustrated in the middle of FIG. 1.

In the road crossing 1 illustrated in FIG. 1, on the left-hand side thereof a portion of the track body of a track G1, and on the right-hand side a portion of the track body of a track G2 is illustrated. The entire track bodies result from a reflection of the parts illustrated about the respective central track plane A1 or A2, respectively, extending in the middle of the track body in the longitudinal direction of the track. The rails of the track G1 are denoted by 2, and those of the track G2 are denoted by 3. The roadway of this road crossing is formed by self-supporting slabs in the region of the tracks G1 and G2, i.e. by inner slabs 4 bridging the space 5 between the two rails 2 and 3, respectively, of the respective track G1 and G2, respectively, and outer slabs 6 each covering a strip-shaped region 7 externally of the rails of the respective track. The inner slabs 4 rest on the inwardly pointing bases 2*a* and 3*a*, respectively, of the rails 2 and 3, respectively, with elastic bearings 8 interposed, and are retained against shifting by the webs of the rails 2 and 3, respectively. On their side 6*a* facing the rails 2 and 3, respectively, the outer slabs 6 are elastically supported on the outwardly arranged bases 2*b* and 3*b*, respectively, of the rails 2 and 3, respectively, with elastic bearings 9 inserted; at their side 6*b* facing away from the rails 2 and 3, respectively, the outer plates 6 are supported on supporting bodies 10 laid beside the respective track G1 or G2, respectively.

In the region Z located in the middle between the two tracks G1, G2, the roadway is formed by a filling in the form of compensating slabs 11 made of concrete. At both of their longitudinal rims 12, these compensating slabs 11 are supported on the supporting bodies 10 which also support the outer slabs 6. The supporting bodies 10 proper are mounted on pedestals 13 made of site-mixed concrete. On their upper side, the supporting bodies 10 comprise a longitudinally extending rib 14 separating the supporting surface 15 provided for the outer slabs 6 from the supporting surface 16 provided for the compensating slabs 11. On these two supporting surfaces 15, 16, elastic ledges 17, 18 are arranged on which the outer slabs 6 and the compensating slabs 11 rest. Advantageously, elastic ledges 27, 28 are also provided between the lateral surfaces 14*b*, 14*c* of the ribs 14 and the lateral surfaces of the compensating slabs 11 and also the lateral surfaces 6*c* of the outer slabs 6. Such ledges preferably are made of elastomer material. Optionally, the outer slabs 6 and/or the compensating slabs 11 may also directly rest on the supporting bodies 10; mounting on elastic ledges is, however, preferred. The compensating slabs 11 preferably are made of polymer concrete, polyester concrete being particularly advantageous.

Figure 3:
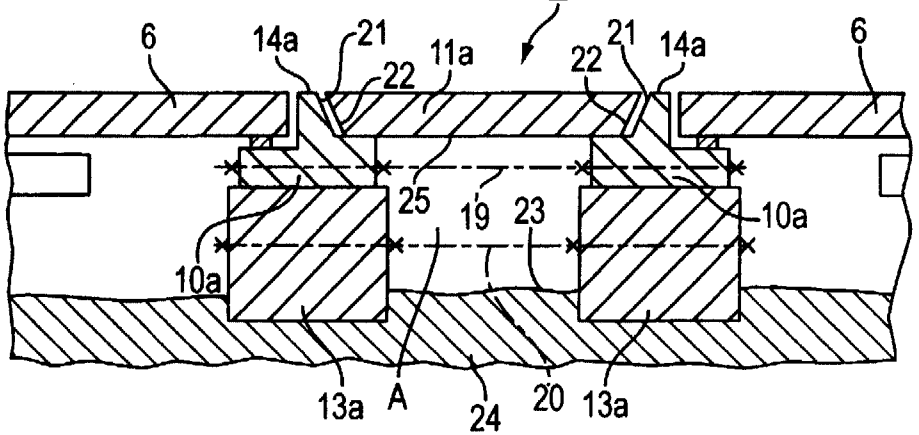
FIG. 3 is a different embodiment of such a road crossing in a cross-sectional illustration corresponding to FIG. 1.

A further embodiment of the road crossing is illustrated in FIG. 3. In this embodiment, the supporting bodies 10*a* are mounted on pedestals made of concrete blocks 13*a* and interconnected by means of spacers 19. This results in an exact positioning of the supporting bodies 10*a* relative to each other. Furthermore, as illustrated, to secure the concrete blocks against dislocation thereof, these concrete blocks 13*a* may additionally be fixed in their positions relative to each other by spacers 20, and this embodiment is particularly important if extreme traffic loads occur. In this embodiment, the supporting bodies 10*a* have longitudinally extending ribs 14*a* whose lateral surfaces 21 facing the compensating slabs 11*a* extend obliquely. The edge surfaces 22 of the compensating slabs 11*a* extend also obliquely, corresponding to the lateral surfaces 21 of the ribs 14*a*. In this embodiment, the compensating slabs 11*a* rest directly on the supporting bodies 10*a*; if desired, here, too, mounting on interposed elastic ledges (not shown) is possible.

Figure 2:
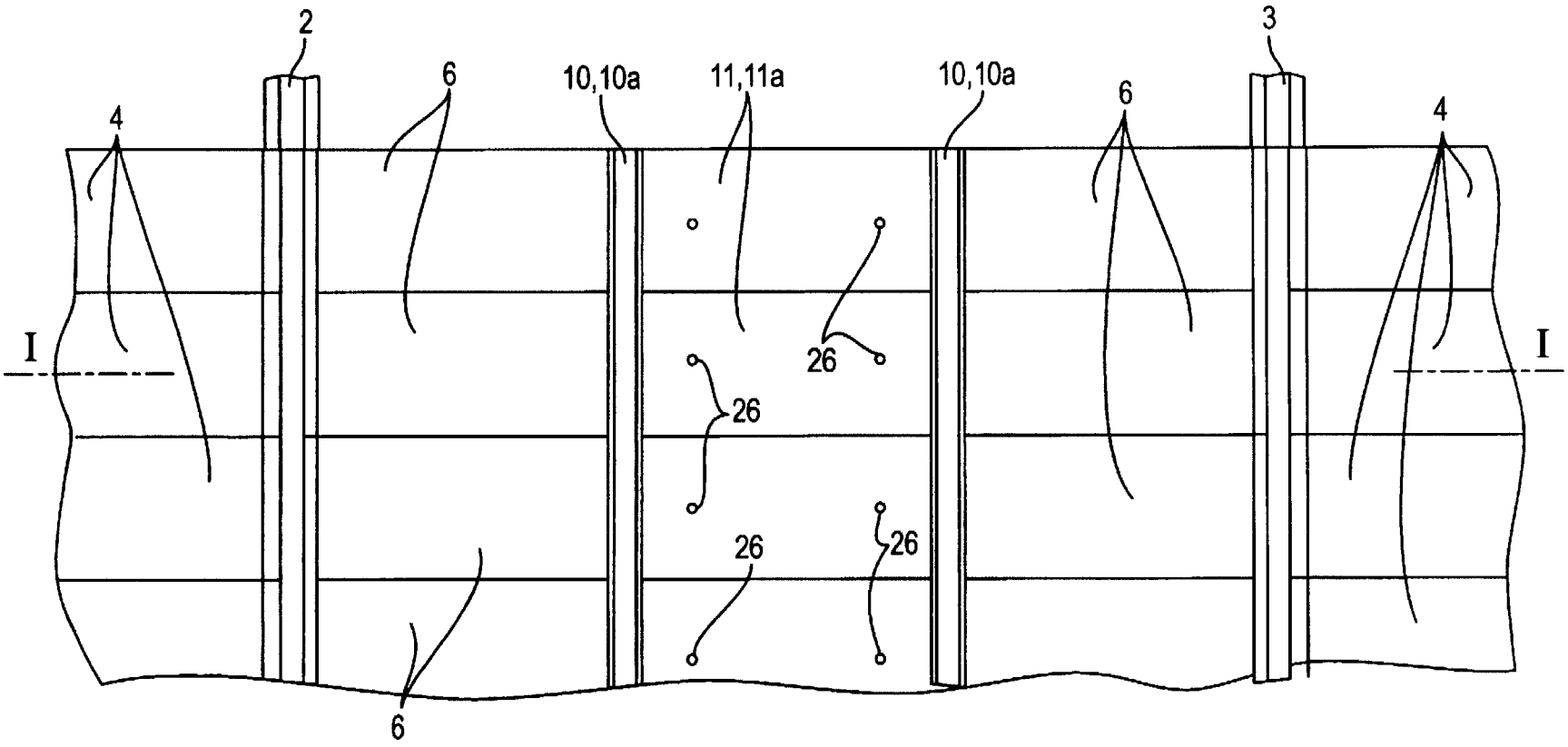
FIG. 2 is a top view onto the road crossing illustrated in FIG. 1.

Space A below the compensating slabs 11 or 11*a* and illustrated in FIGS. 1 and 3, which is laterally delimited by the supporting bodies 10 or 10*a*, respectively, the associated pedestals 13 or 13*a*, respectively, and the surface 23 of the soil 24 and the lower side 25 of the slab is available for laying cables, pipes or the like therein. In FIG. 2, apertures 26 recessed in the compensating slabs 11 or 11*a*, respectively, are indicated which facilitate transporting and laying of the compensating slabs or dismounting thereof, respectively, by means of lifting devices for maintenance purposes.

I claim:

1. A multi-track road crossing including a roadway positioned at the level of at least two tracks, each track comprising a pair of rails with each rail having an internally and an externally extending rail base, said roadway being formed at each of the tracks of the road crossing by self-supporting slabs elastically supported on the bases of the rails on at least one side of each slab, comprising inner slabs bridging a space between the two rails of a respective track and being only supported on two said rails and outer slabs each covering a strip-shaped region externally of the rails of the respective track, said outer slabs being elastically supported at sides thereof facing the rails on the externally extending rail bases and said outer slabs being supported on opposite sides facing away from the rails on supporting bodies which are laid on the ground adjacent the respective track, an intermediate area arranged in said road crossing between adjacent tracks, wherein the roadway is formed in said intermediate area by compensating slabs which bridge in a self-supporting manner said intermediate area, said compensating slabs having longitudinal rims and being supported with both of their longitudinal rims only on said supporting bodies which also support said outer slabs disposed adjacent said intermediate area.

2. A multi-track road crossing according to claim 1, wherein the supporting bodies are mounted on pedestals of site-mixed concrete or of concrete blocks.

3. A multi-track road crossing according to claim 1, wherein said supporting bodies are connected by spacers with said supporting bodies disposed at opposite sides of the intermediate area.

4. A multi-track road crossing according to claim 2, wherein said supporting bodies are connected by spacers with said supporting bodies disposed at opposite sides of the intermediate area.

5. A multi-track road crossing according to any one of claims 1, 2, 3 or 4, wherein the supporting bodies each include an upwardly extending longitudinal rib which separates a supporting surface for the outer slabs from a supporting surface for the compensating slabs.

6. A multi-track road crossing according to any one of claims 1, 2, 3 or 4, wherein the supporting bodies each include an upwardly extending longitudinal rib which separates a supporting surface for the outer slabs from a supporting surface for the compensating slabs, the longitudinal ribs having lateral surfaces facing the supporting surfaces for the compensating slabs, said lateral surfaces extending obliquely toward opposite lateral surfaces of the ribs in an upward direction and wherein longitudinal edge surfaces of the compensating slabs extending parallel to said ribs also extend obliquely, corresponding to the obliquely extending lateral surfaces of the longitudinal ribs of the supporting bodies.

7. A multi-track road crossing according to any one of claims 1, 2, 3 or 4, wherein the compensating slabs are formed of polymer concrete.

8. A multi-track road crossing according to any one of claims 1, 2, 3 or 4, wherein the compensating slabs are formed of polymer concrete and wherein the supporting bodies each include an upwardly extending longitudinal rib which separates a supporting surface for the outer slabs from a supporting surface for the compensating slabs.

9. A multi-track road crossing according to any one of claims 1, 2, 3 or 4, wherein the compensating slabs are formed of polymer concrete and wherein the supporting bodies each include an upwardly extending longitudinal rib which separates a supporting surface for the outer slabs from a supporting surface for the compensating slabs, the longitudinal ribs having lateral surfaces facing the supporting surfaces for the compensating slabs, said lateral surfaces extending obliquely and toward opposite lateral surfaces of the ribs in an upward direction and wherein longitudinal edge surfaces of the compensating slabs extending parallel to said ribs also extend obliquely, corresponding to the obliquely extending lateral surfaces of the longitudinal ribs of the supporting bodies.

10. A multi-track road crossing according to any one of claims 1, 2, 3 or 4, wherein the compensating slabs are formed of polyester concrete.

11. A multi-track road crossing according to any one of claims 1, 2, 3 or 4, wherein the compensating slabs are formed of polyester concrete and wherein the supporting bodies each include an upwardly extending longitudinal rib which separates a supporting surface for the outer slabs from a supporting surface for the compensating slabs.

12. A multi-track road crossing according to any one of claims 1, 2, 3 or 4, wherein the compensating slabs are formed of polyester concrete and wherein the supporting bodies each include an upwardly extending longitudinal rib which separates a supporting surface for the outer slabs from a supporting surface for the compensating slabs, the longitudinal ribs having lateral surfaces facing the supporting surfaces for the compensating slabs, said lateral surfaces extending obliquely and toward opposite lateral surfaces of the ribs in an upward direction and wherein longitudinal edge surfaces of the compensating slabs extending parallel to said ribs also extend obliquely, corresponding to the obliquely extending lateral surfaces of the longitudinal ribs of the supporting bodies.

* * * * *